US012222147B2

(12) United States Patent
Bunce et al.

(10) Patent No.: US 12,222,147 B2
(45) Date of Patent: Feb. 11, 2025

(54) TRANS-CRITICAL THERMODYNAMIC SYSTEM AND METHOD FOR REMOVING SOLUTES FROM FLUID

(71) Applicant: ROLLS-ROYCE PLC, London (GB)

(72) Inventors: Ian M Bunce, Derby (GB); Chloe J Palmer, Derby (GB)

(73) Assignee: ROLLS-ROYCE plc, London (GB)

( * ) Notice: Subject to any disclaimer, the term of this patent is extended or adjusted under 35 U.S.C. 154(b) by 495 days.

(21) Appl. No.: 17/761,429

(22) PCT Filed: Sep. 3, 2020

(86) PCT No.: PCT/EP2020/074657
§ 371 (c)(1),
(2) Date: Mar. 17, 2022

(87) PCT Pub. No.: WO2021/058255
PCT Pub. Date: Apr. 1, 2021

(65) Prior Publication Data

US 2022/0364772 A1 Nov. 17, 2022

(30) Foreign Application Priority Data

Sep. 26, 2019 (GB) ..... 1913880

(51) Int. Cl.
*F25B 9/06* (2006.01)
*F25B 9/00* (2006.01)
*F25B 43/04* (2006.01)

(52) U.S. Cl.
CPC ..... *F25B 9/06* (2013.01); *F25B 9/008* (2013.01); *F25B 43/043* (2013.01); *F25B 2309/061* (2013.01)

(58) Field of Classification Search
None
See application file for complete search history.

(56) References Cited

U.S. PATENT DOCUMENTS 8,048,304 B2 * 11/2011 Waibel ..... B01D 11/0296 165/4
8,479,526 B2 * 7/2013 Matsuoka ..... F25B 9/008 62/529
2006/0010904 A1 * 1/2006 Nieter ..... F04B 39/066 62/505

(Continued)

FOREIGN PATENT DOCUMENTS

DE 10 2010 024563 A1 12/2011
JP 2003-139420 A 5/2003
WO 2017/083684 A1 5/2017

OTHER PUBLICATIONS

DE102010024563A1 English machine translation (Year: 2011).*

(Continued)

*Primary Examiner* — Jenna M Maroney
(74) *Attorney, Agent, or Firm* — Oliff PLC

(57) ABSTRACT

A trans-critical thermodynamic system includes an expansion device and a separator. The expansion device receives a supercritical fluid containing solutes. The expansion device is operable to expand the supercritical fluid to produce a sub-critical gas by reducing a temperature and/or a pressure of the supercritical fluid. The separator removes the solutes from the sub-critical gas.

13 Claims, 7 Drawing Sheets

(56) References Cited

U.S. PATENT DOCUMENTS

2022/0364772 A1* 11/2022 Bunce ..... F25B 9/06

OTHER PUBLICATIONS

Jan. 11, 2021 International Search Report issued in International Patent Application No. PCT/EP2020/074657.
Jan. 11, 2021 Written Opinion issued in International Patent Application No. PCT/EP2020/074657.
Mar. 24, 2020 Search Report issued in British Patent Application No. 1913880.9.

* cited by examiner

TRANS-CRITICAL THERMODYNAMIC SYSTEM AND METHOD FOR REMOVING SOLUTES FROM FLUID

FIELD OF THE DISCLOSURE

The present disclosure concerns removal of solutes from a working fluid in a trans-critical thermodynamic circuit or system.

BACKGROUND

A trans-critical cycle is a thermodynamic cycle where a working fluid goes through the critical point into the supercritical state in part of the cycle. This is often the case when carbon dioxide ($CO_2$) is the working fluid. Supercritical carbon dioxide ($sCO_2$) is a fluid state of carbon dioxide where it is held at or above its critical temperature and critical pressure. sCO2 as a working fluid is typically a very good solvent. Supercritical CO2 has been used for extracting flavours in food processing, such as coffee bean processing, due to its solvent properties. Furthermore, $sCO_2$ dissolves oils rapidly and comprehensively.

As sCO2 dissolves oils rapidly and tends to effuse into components due to a very low fluid viscosity, sCO2 may cause problems for rotating or sliding machinery, such as bearings, compressors, or pistons, by dissolving lubricants rapidly. The dissolved oils can also modify the properties of the working fluid. It is therefore necessary to remove solutes from a working fluid in a trans-critical cycle. Conventional methods of removing solutes generally involve complete purging of the system and filtration systems that interfere with normal operation.

SUMMARY OF THE DISCLOSURE

In one aspect, there is provided a trans-critical thermodynamic system including an expansion device and a separator. The expansion device receives a supercritical fluid containing solutes. The expansion device is operable to expand the supercritical fluid to produce a sub-critical gas by reducing a temperature and/or a pressure of the supercritical fluid. The separator removes the solutes from the sub-critical gas.

The trans-critical thermodynamic system may allow contaminants in the working fluid to be removed during normal operation as opposed to complete purging of the system. Oil-lubricated components may be used without any risk of damaging downstream components. The working fluid may be purified periodically to achieve optimal performance. Further, the controlled periodical removal of the contaminants may have a lower impact on system efficiency compared with conventional methods. Moreover, the trans-critical thermodynamic system may not require additional separating components, such as filters or strainers that have an associated pressure drop and are susceptible to flow damage.

The trans-critical thermodynamic systems of the present disclosure may be used for thermal management and/or waste heat recovery in various applications, for example, but not limited to, gas turbine engines, internal combustion engines, computing facilities, and heating, cooling and ventilation (HVAC) applications.

In some embodiments, the trans-critical thermodynamic system further includes a high-pressure circuit and a fluid extraction point. The supercritical fluid flows through the high pressure circuit. The fluid extraction point is operable to extract a portion of the supercritical fluid from the high pressure circuit. The expansion device is operable to expand the portion of the supercritical fluid.

By extracting only the portion of the supercritical fluid, an amount of working fluid being passed through the separator is reduced. For example, the portion of the supercritical fluid may be a minimum amount required to maintain an amount of solute (e.g., dissolved oils) in the working fluid below a threshold. This may advantageously reduce energy losses in the trans-critical thermodynamic system.

In some embodiments, the trans-critical thermodynamic system further includes a low pressure circuit and a compressor. The compressor is operable to compress a working fluid from the low-pressure circuit into the high-pressure circuit such that the working fluid becomes the supercritical fluid.

In some embodiments, the trans-critical thermodynamic system further includes a first heat exchanger in the high pressure circuit receiving the supercritical fluid from the compressor. The fluid extraction point is located after the first heat exchanger. The first heat exchanger is configured to cool the supercritical fluid to a thermodynamic state such that the reduction in the temperature and/or the pressure when the portion of the supercritical fluid is passed through the expansion device produces the sub-critical gas having a thermodynamic state matching a position in the low pressure circuit. The thermodynamic state of the sub-critical gas has a temperature less than a temperature at an inlet of the compressor.

The first heat exchanger may advantageously allow control of the thermodynamic properties of the portion of the supercritical fluid that is extracted for passage through the separator. For example, the thermodynamic state of the portion of the supercritical fluid may be chosen so that there is minimal energy loss through the expansion device. Further, the thermodynamic state of the portion of the supercritical fluid may be controlled to avoid returning hot fluid to the inlet of the compressor which can otherwise pose a risk of an unstable supercritical temperature of the working fluid. In some cases, an energy transfer in the first heat exchanger can be adjusted based on a desired thermodynamic state of the portion of the supercritical fluid. Various control strategies may be used to control the energy transfer in the first heat exchanger.

In some embodiments, the trans-critical thermodynamic system further includes a controller operable to control a rate of energy transfer in the first heat exchanger based on a measure of one or more thermodynamic properties of the supercritical fluid at the fluid extraction point.

In some embodiments, the trans-critical thermodynamic system further includes a bypass circuit, a mixing valve and a controller. The bypass circuit diverts a fraction of the supercritical fluid around the first heat exchanger. The mixing valve mixes the supercritical fluid that has passed through the first heat exchanger with the supercritical fluid that has bypassed the first heat exchanger.

The controller controls the mixing valve based on a measure of one or more thermodynamic properties of the supercritical fluid at the fluid extraction point.

In some embodiments, the trans-critical thermodynamic system further includes one or more control members operable to control a rate of flow of a heat transfer fluid across the first heat exchanger. The trans-critical thermodynamic system further includes a controller to control the one or more control members based on a measure of one or more thermodynamic properties of the supercritical fluid at the fluid extraction point.

In some embodiments, the trans-critical thermodynamic system further includes a solute sensor operable to measure a value representative of an amount of solute in the supercritical fluid. The portion of the supercritical fluid extracted to pass through the expansion device is controlled based on the value to maintain the amount of solute in the supercritical fluid below a threshold.

In some embodiments, the solute sensor is operable to measure a rate of solute collection in the separator.

In some embodiments, the fluid extraction point is in fluid communication with a cooling circuit. The supercritical fluid in the high-pressure circuit that is not extracted at the fluid extraction point is circulated through the cooling circuit. The cooling circuit further includes at least one heat exchanger and another expansion device.

In some embodiments, the trans-critical thermodynamic system further includes a second heat exchanger receiving the sub-critical gas from the separator.

In some embodiments, the trans-critical thermodynamic system further includes a high pressure circuit, a low pressure circuit, a pump and a heat recovery heat exchanger. The pump is operable to pressurize a working fluid from the low pressure circuit into the high pressure circuit such that the working fluid becomes a pressurized liquid. The heat recovery heat exchanger in the high pressure circuit receives the pressurized liquid and heats the pressurized liquid to a supercritical fluid. The expansion device receives the supercritical fluid from the heat recovery heat exchanger.

An entire flow of the working fluid can be purified in situ within the main loop. Therefore, contaminants may be quickly removed and not re-circulated. Since the separator is positioned downstream of the expansion device, fouling of the first heat exchanger by the contaminants can be prevented.

In another aspect, there is provided a method of removing solutes from a working fluid in a trans-critical circuit. The method includes identifying a position in the trans-critical circuit where the working fluid is a sub-critical gas. The method further includes positioning a separator such that the separator receives at least a portion of the working fluid when the working fluid is the sub-critical gas. The separator is operable to remove solutes from the sub-critical gas.

In some embodiments, the method further includes identifying a fluid extraction point in the trans-critical circuit where the working fluid is a supercritical fluid. The method further includes extracting a portion of the supercritical fluid from the fluid extraction point in the trans-critical circuit. The method further includes passing the portion of the supercritical fluid through an expansion device such that the portion of the supercritical fluid becomes the sub-critical gas.

In some embodiments, the method further includes compressing the working fluid upstream of the fluid extraction point such that the working fluid becomes the supercritical fluid. The method further includes passing at least a fraction of the supercritical fluid through a first heat exchanger located upstream of the fluid extraction point. The method further includes controlling a rate of energy transfer in the first heat exchanger based on a measure of one or more thermodynamic properties of the supercritical fluid at the fluid extraction point.

In the invention, the working fluid is preferably carbon dioxide, however any working fluid that dissolves contaminants more significantly when in a supercritical state may benefit from the invention disclosed herein.

BRIEF DESCRIPTION OF THE DRAWINGS

Embodiments will now be described by way of example only, with reference to the Figures, in which.

DETAILED DESCRIPTION

Figure 1:
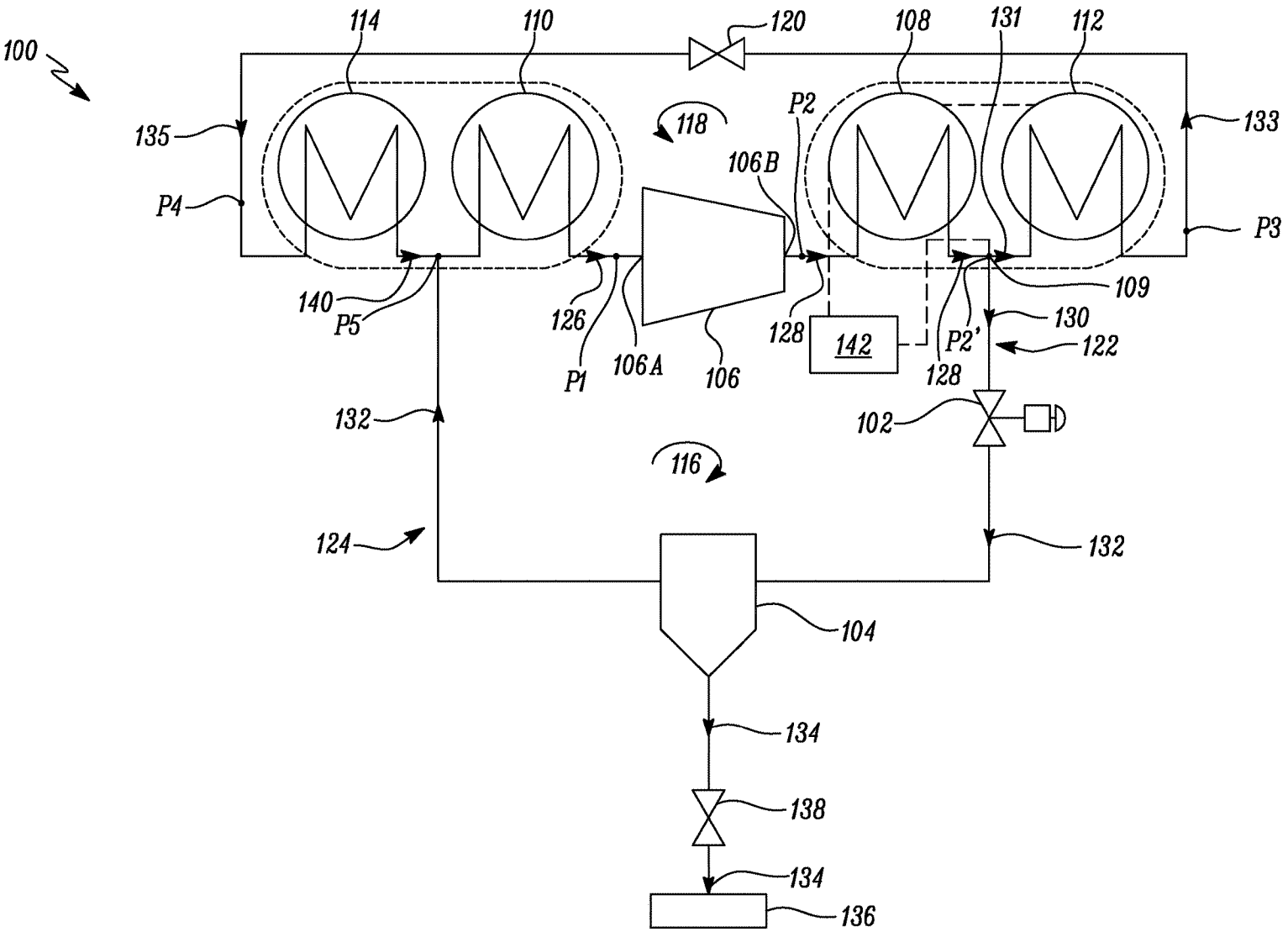
FIG. 1 is a schematic view of a first example of a trans-critical thermodynamic system.
Figure 2:
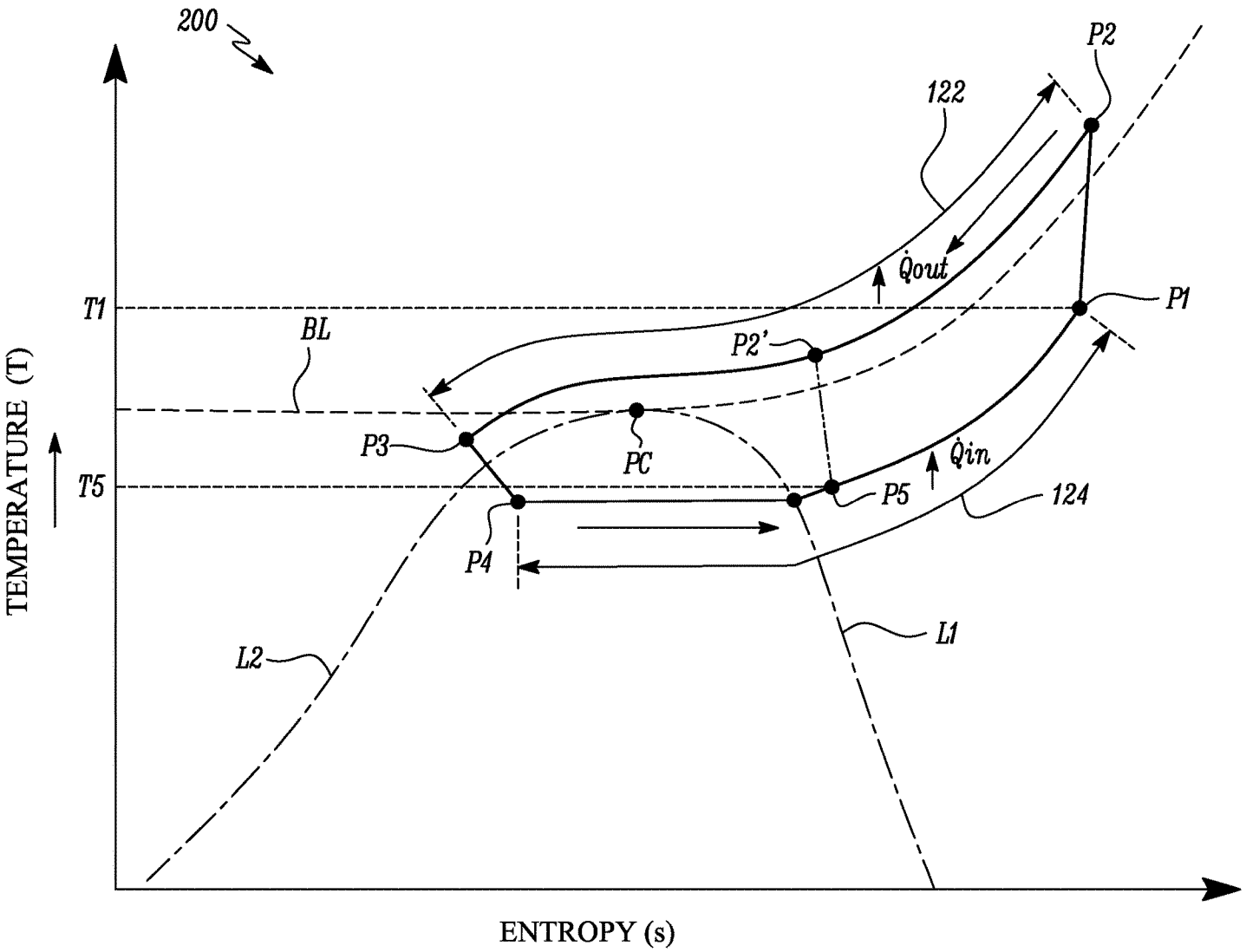
FIG. 2 is a plot of an exemplary thermodynamic cycle for the trans-critical thermodynamic system of FIG. 1.

With reference to FIG. 1, a trans-critical thermodynamic system 100 (hereinafter referred to as "the trans-critical system 100") is provided. The trans-critical system 100 includes an expansion device 102, a separator 104, a compressor 106, a first heat exchanger 108, a fluid extraction point 109, a second heat exchanger 110, a third heat exchanger 112, and a fourth heat exchanger 114. The trans-critical system 100 uses a working fluid. In some embodiments, the working fluid is carbon dioxide ($CO_2$). FIG. 2 illustrates a plot 200 of temperature (T) versus entropy (s) of the trans-critical system 100. Specifically, the plot 200 is a T-s diagram of the trans-critical system 100. FIG. 2 also schematically illustrates a critical point PC of the working fluid, a saturated vapour line L1 of the working fluid, a saturated liquid line L2 of the working fluid, and a critical boundary line BL between a supercritical state and a sub-critical state of the working fluid. The critical point PC for $CO_2$ is at 7.36 MPa (1067 psia) and 31 degrees Celsius (88 degrees Fahrenheit) such that the supercritical state for $CO_2$ occurs at or above the critical point PC. A trans-critical cycle is a thermodynamic cycle where the working fluid goes through both sub-critical and supercritical states.

Referring to FIGS. 1 and 2, the trans-critical system 100 includes a trans-critical circuit 116 and a cooling circuit 118. The trans-critical circuit 116 includes the expansion device 102, the separator 104, the compressor 106, the first heat exchanger 108, and the second heat exchanger 110. The trans-critical circuit 116 may be a closed-loop circuit. The cooling circuit 118 includes the third heat exchanger 112, the fourth heat exchanger 114 and another expansion device 120 (hereinafter referred to as "the second expansion device 120").

Various points in the flow path of the working fluid are defined in the trans-critical system 100. Point P1 is defined in the flow path of the working fluid where a flow of the working fluid is provided at an inlet 106A of the compressor 106. Point P2 is defined in the flow path of the working fluid where a flow of the working fluid is received from an outlet 1066 of the compressor 106. Point P2' is defined in a flow path of the working fluid where a portion of a flow of the working fluid is extracted and provided to the expansion device 102. Point P2' coincides with the fluid extraction point 109. Point P3 is defined in the flow path of the working fluid where a flow of the working fluid is received from an outlet of the third heat exchanger 112. Point P4 is defined in the flow path of the working fluid where a flow of the working fluid is received from an outlet of the second expansion device 120. Point P5 is defined in the flow path of the working fluid where a flow of the working fluid is provided to an inlet of the second heat exchanger 110. The working fluid may be in different thermodynamic states in the trans-critical system 100, for example, supercritical state, sub-critical gas, sub-critical liquid, sub-critical liquid and gas mixture, and so forth.

The trans-critical system 100 further includes a high pressure circuit 122 and a low pressure circuit 124. The high pressure circuit 122 is defined from point P2 to point P3. The low pressure circuit 124 is defined from point P4, through point P5, to point P1. The high pressure circuit 122 generally operates at a greater average pressure than the low pressure circuit 124. For a given value of entropy, a point in the high pressure circuit 122 has a higher pressure than a corresponding point in the low pressure circuit 124.

The compressor 106 receives the working fluid from the low pressure circuit 124 at the inlet 106A. The compressor 106 receives the flow of working fluid from point P1. At point P1, the working fluid in a sub-critical gas 126. In some embodiments, the sub-critical gas 126 is $CO_2$ in the sub-critical gaseous state. The compressor 106 is operable to compress the working fluid from the low pressure circuit 124 such that the working fluid becomes a supercritical fluid 128. In some embodiments, the supercritical fluid 128 is supercritical carbon dioxide ($sCO_2$). The compressor 106 may be directly or indirectly driven by a shaft of a gas turbine engine. The compressor 106 compresses the flow of the working fluid and increases the temperature and pressure of the working fluid at point P2. The compression of the working fluid may be substantially isentropic. The compressor 106 may be any form of mechanism or device capable of compressing the working fluid such that working fluid received at a lower pressure by the compressor 106 is output at a higher pressure. Point P2 may be above the critical point PC and the critical boundary line BL of the working fluid.

The supercritical fluid 128, from the outlet 106B of the compressor 106, flows through the high pressure circuit 122. The first heat exchanger 108 is disposed in the high pressure circuit 122 after the compressor 106. In other words, the first heat exchanger 108 is disposed downstream of the compressor 106. At least a fraction of the supercritical fluid 128 provided at the outlet 106B of the compressor 106 is provided to the first heat exchanger 108. The first heat exchanger 108 may be any device that allows heat exchange between the working fluid and a heat transfer fluid (another liquid or gas) without mixing the working fluid and the heat transfer fluid together. The first heat exchanger 108 is configured to cool the supercritical fluid 128 from point P2 to point P2'.

The fluid extraction point 109 is operable to extract a portion 130 of the supercritical fluid 128 from the high pressure circuit 122. In some embodiments, the portion 130 of the supercritical fluid 128 that is extracted at the fluid extraction point 109 can be varied based on various parameters. The expansion device 102 is operable to expand the supercritical fluid 128 to produce a sub-critical gas 132 by reducing a temperature and/or a pressure of the supercritical fluid 128. Specifically, the expansion device 102 reduces the temperature and the pressure of the portion 130 of the supercritical fluid 128 from point P2' to point P5.

The fluid extraction point 109 is in fluid communication with the cooling circuit 118. The supercritical fluid 128 in the high pressure circuit 122 that is not extracted at the fluid extraction point 109 is circulated through the cooling circuit 118. Specifically, a portion 131 of the supercritical fluid 128 is not extracted at the fluid extraction point 109 and is circulated through the cooling circuit 118. The portion 131 of the supercritical fluid 128 passes through the third heat exchanger 112. The third heat exchanger 112 cools the portion 131 of the supercritical fluid 128 to a sub-critical liquid 133 at point P3. The sub-critical liquid 133 at point P3 is passed through the second expansion device 120. The second expansion device 120 reduces a temperature and/or a pressure of the sub-critical liquid 133 to a sub-critical liquid and gas mixture 135 at point P4. The sub-critical liquid and gas mixture 135 at point P4 is passed through the fourth heat exchanger 114. The fourth heat exchanger 114 heats the sub-critical liquid and gas mixture 135 to a sub-critical gas 140 at point P5. Point P5 may lie beyond the saturated vapour line L1. The fourth heat exchanger 114 may add a degree of superheat to the working fluid.

The separator 104 removes one or more solutes 134 from the sub-critical gas 132 received from the expansion device 102. The solutes 134 may condense out of the sub-critical gas 132 and flow out of the separator 104. The separator 104 may be any device that can separate the solutes 134 (e.g., oil) from a gas (e.g., the sub-critical gas 132). The solutes 134 from the separator 104 may flow to a drain 136. An outlet valve 138 may be provided to control a flow of the solutes 134 from the separator 104 to the drain 136. In some embodiments, the separator 104 may be a vapour-liquid separator. In some embodiments, the separator 104 can be an oil separator.

The second heat exchanger 110 receives at least the sub-critical gas 132 from the separator 104. At point P5, the sub-critical gas 132 from the separator 104 may mixed with the sub-critical gas 140 from the fourth heat exchanger 114. The sub-critical gas 132 and the sub-critical gas 140 may be in substantially a same thermodynamic state. The sub-critical gas 132 and the sub-critical gas 140 mix to form the sub-critical gas 126. The sub-critical gas 126 from point P5 is provided to the second heat exchanger 110. Point P5 may lie beyond the saturated vapour line L1 to ensure that no liquid is provided at the inlet 106A of the compressor 106. The second heat exchanger 110 heats the sub-critical gas 126 to point P1. Point P1 may lie below the critical boundary line BL. The compressor 106 compresses the sub-critical gas 126 at point P1 to the supercritical fluid 128 at point P2. After compression, at least a fraction of the supercritical fluid 128 is provided to the first heat exchanger 108.

A thermodynamic state at the fluid extraction point 109 may be selected to ensure that the working fluid loses the minimum amount of energy while reducing the temperature and/or the pressure by expansion to provide the sub-critical gas 132. This may be achieved by extracting the working fluid at a point where the reduction in the temperature and/or a pressure by expansion results in the sub-critical gas 132 just outside the saturated vapour line L1. The degree of superheat of the sub-critical gas 132 may therefore be minimized.

Selection of the thermodynamic state at the fluid extraction point 109 may be achieved by passing the supercritical fluid 128 through the first heat exchanger 108. The first heat exchanger 108 may extract heat from the supercritical fluid 128 at a rate of energy transfer $\dot{Q}$out. The thermodynamic state at the fluid extraction point 109 may be controlled by regulating the rate of energy transfer $\dot{Q}$out. The rate of energy transfer ° out (or the energy transfer) in the first heat exchanger 108 may be selected to provide a calculated specific entropy of the working fluid greater than the saturated vapour line L1 but colder than a temperature T1 at the inlet 106A of the compressor 106. This may result in minimal loss of energy through the expansion device 102. Further, it may also avoid providing hot fluid to the inlet 106A which can otherwise pose a risk of an unstable supercritical temperature of the working fluid.

In some embodiments, the first heat exchanger 108 is configured to cool the supercritical fluid 128 to a thermodynamic state such that the reduction in the temperature and/or the pressure when the portion 130 of the supercritical fluid 128 is passed through the expansion device 102 produces the sub-critical gas 132 having a thermodynamic state matching a position in the low pressure circuit 124. The thermodynamic state of the sub-critical gas 132 has a temperature T5 less than the temperature T1 at the inlet 106A of the compressor 106.

The energy transfer in the first heat exchanger 108 may be selected to match desired thermodynamic properties of the trans-critical system 100. In some embodiments, the rate of energy transfer ° out in the first heat exchanger 108 may be controlled to maintain the fluid extraction point 109 at the desired thermodynamic state. In some embodiments, the trans-critical system 100 includes a controller 142 operable to control the rate of energy transfer ° out in the first heat exchanger 108 based on a measure of one or more thermodynamic properties of the supercritical fluid 128 at the fluid extraction point 109. In some embodiments, the controller 142 may control flow to or from a bypass circuit (not shown in FIGS. 1 and 2) that bypasses the first heat exchanger 108 in order to control the rate of energy transfer $\dot{Q}$out. In some embodiments, the controller 142 may vary the flow of the heat transfer fluid over the first heat exchanger 108 in one or more stages in order to control the rate of energy transfer $\dot{Q}$out.

Further, the second heat exchanger 110 may provide heat to the sub-critical gas 126 at a rate of energy transfer $\dot{Q}$in. In some embodiments, the controller 142 may also control the rate of energy transfer $\dot{Q}$in in the second heat exchanger 110.

The portion 130 of the supercritical fluid 128 extracted to pass through the separator 104 may be a minimum amount required to maintain an amount of solute (e.g., dissolved oils) in the working fluid below a threshold. This may advantageously reduce energy losses in the trans-critical circuit 116. For example, a percentage of the total flow of the supercritical fluid 128 extracted at the fluid extraction point 109 for expansion may be less than 1%, less than 2%, less than 5%, less than 10%, less than 20%, less than 30%, less than 40%, or less than 50%. The passage of the supercritical fluid 128 through the fluid extraction point 109 may be controlled based on an amount of solute collected in the separator 104.

In some embodiments, the controller 142 may control the portion 130 of the supercritical fluid 128 extracted to pass through the expansion device 102 based on an amount of solute in the supercritical fluid 128. In some embodiments, a valve (not shown in FIGS. 1 and 2) may be provided at the fluid extraction point 109 to control the portion 130 of the supercritical fluid 128 that is extracted for passage through the expansion device 102.

The trans-critical system 100 and the plot 200, as illustrated in FIGS. 1 and 2, are exemplary in nature. Various components of the trans-critical system 100 may be selected based on the application requirements of the trans-critical system 100.

In the illustrated embodiment of FIG. 1, each of the expansion device 102 and the second expansion device 120 is an expansion valve, such as a thermostatic expansion valve. In some embodiments, an opening of the expansion valve be variable. In alternative embodiment, at least one of the expansion device 102 and the second expansion device 120 can be a turbine.

In some embodiments, one or more of the first heat exchanger 108, the second heat exchanger 110, the third heat exchanger 112 and the fourth heat exchanger 114 can be a liquid-to-gas heat exchanger, a gas-to-gas heat exchanger or a liquid-to-liquid heat exchanger. Each of the first heat exchanger 108, the second heat exchanger 110, the third heat exchanger 112 and the fourth heat exchanger 114 can include, but not limited to, shell and tube heat exchangers, plate heat exchangers, plate and shell heat exchangers, plate fin heat exchangers and microchannel heat exchangers.

In some embodiments, the first heat exchanger 108 and the third heat exchanger 112 can be part of a single heat exchanger assembly with the fluid extraction point 109 located in an intermediate location within the single heat exchanger assembly. In some other embodiments, the first heat exchanger 108 and the third heat exchanger 112 can be separate heat exchangers, and the fluid extraction point 109 is located between the first heat exchanger 108 and the third heat exchanger 112.

In some embodiments, the second heat exchanger 110 and the fourth heat exchanger 114 can be part of a single heat exchanger assembly with point P5 located in an intermediate location within the single heat exchanger assembly. In some other embodiments, the second heat exchanger 110 and the fourth heat exchanger 114 can be separate heat exchangers, and point P5 is located between the second heat exchanger 110 and the fourth heat exchanger 114.

In some embodiments, the compressor 106 can be a positive displacement compressor, a dynamic compressor or any other type of compressor. Examples of positive displacement compressors include, but not limited to, reciprocating compressors (single-acting or double-acting), diaphragm compressors, ionic compressors, screw compressors, lobe compressors, vane compressors, scroll compressors, and rolling piston compressors. Examples of dynamic compressors include, but not limited to, air bubble compressors, centrifugal compressors, axial compressors, and mixed-flow compressors. The compressor 106 may be hermetically sealed, open, or semi-hermetic.

The trans-critical system 100 may include additional components not shown in FIGS. 1 and 2. For example, the trans-critical system 100 may include one or more fluid conduits, fluid connectors, fluid seals and reservoirs. Further the cooling circuit 118 may include any number of heat exchangers and expansion devices as per application requirements.

Figure 3:
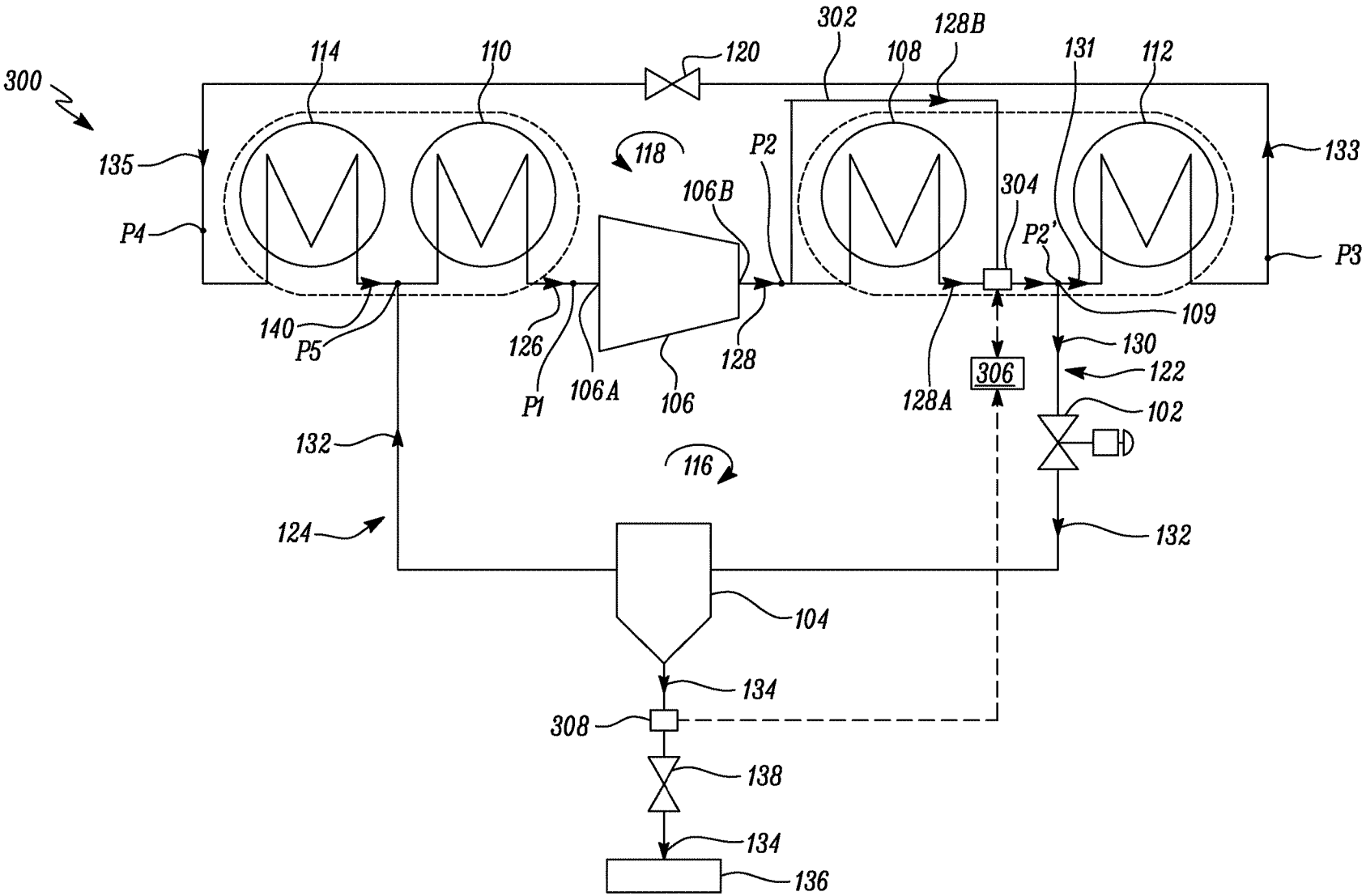
FIG. 3 is a schematic view of a second example of a trans-critical thermodynamic system.

FIG. 3 illustrates a trans-critical thermodynamic system 300 (hereinafter referred to as "the trans-critical system 300") according to another embodiment of the present disclosure. The trans-critical system 300 is substantially similar in structure and operation to the trans-critical system 100 described above. Referring to FIGS. 2 and 3, the trans-critical system 300 includes the expansion device 102, the separator 104, the compressor 106, the first heat exchanger 108, the fluid extraction point 109, the second heat exchanger 110, the third heat exchanger 112, and the fourth heat exchanger 114. The trans-critical system 300 further includes a bypass circuit 302, a mixing valve 304, a controller 306 and a solute sensor 308.

The bypass circuit 302 diverts a fraction of the supercritical fluid 128 around the first heat exchanger 108. The supercritical fluid 128 received from the compressor 106 is divided into two flows of the supercritical fluid 128A, 128B. The mixing valve 304 mixes the supercritical fluid 128A that has passed through the first heat exchanger 108 with the supercritical fluid 128B that has bypassed the first heat exchanger 108. The controller 306 controls the mixing valve 304 based on a measure of one or more thermodynamic properties of the supercritical fluid 128 at the fluid extraction point 109. The mixing valve 304 can be provided upstream or before the fluid extraction point 109. In some embodiments, the mixing valve 304 may be a three-way electronically controlled valve. The measured thermodynamic properties of the supercritical fluid 128 at the fluid extraction point 109 may include one or more of temperature, pressure, specific entropy, specific enthalpy and specific volume. The rate of energy transfer ° out in the first heat exchanger 108 can be controlled by regulating the fraction of the supercritical fluid 128 that bypasses the first heat exchanger 108.

The solute sensor 308 is operable to measure a value representative of an amount of solute in the supercritical fluid 128. In some embodiments, the portion 130 of the supercritical fluid 128 extracted to pass through the expansion device 102 is controlled based on the value to maintain the amount of solute in the supercritical fluid below a threshold. In the illustrated embodiment of FIG. 3, the solute sensor 308 is operable to measure a rate of solute collection in the separator 104. In other embodiments, the solute sensor 308 may directly measure the amount of solute in the supercritical fluid 128. Examples of the solute sensor 308 include a flow rate sensor, an optical sensor, or any other kind of sensor. The amount of solute in the supercritical fluid 128 may be measured as a weight percentage of the supercritical fluid 128. Further, the threshold may be a threshold weight percentage.

Figure 4:
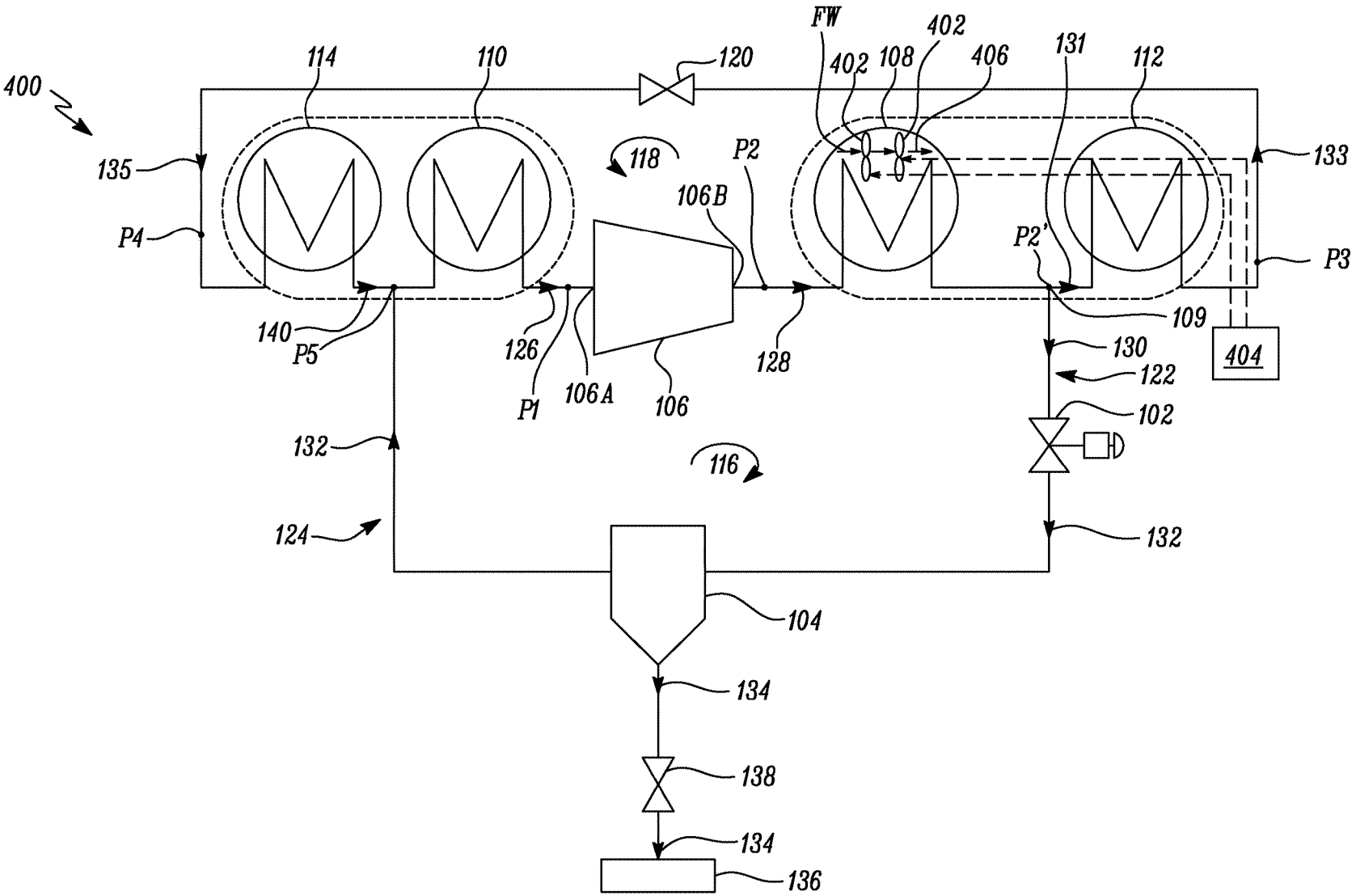
FIG. 4 is a schematic view of a third example of a trans-critical thermodynamic system.

FIG. 4 illustrates a trans-critical thermodynamic system 400 (hereinafter referred to as "the trans-critical system 400") according to another embodiment of the present disclosure. The trans-critical system 400 is substantially similar in structure and operation to the trans-critical system 100 described above. Referring to FIGS. 2 and 4, the trans-critical system 400 includes the expansion device 102, the separator 104, the compressor 106, the first heat exchanger 108, the fluid extraction point 109, the second heat exchanger 110, the third heat exchanger 112, and the fourth heat exchanger 114. The trans-critical system 400 further includes one or more control members 402 and a controller 404.

The one or more control members 402 are operable to control a rate of flow FW of a heat transfer fluid 406 across the first heat exchanger 108. In the illustrated embodiment of FIG. 4, each control member 402 is a blower and the heat transfer fluid 406 is a gas, such as air. The control members 402 can vary the rate of flow FW of the heat transfer fluid 406 in multiple stages (two in FIG. 4). In some embodiments, the control members 402 may additionally or optionally also include valves, vanes and ducts that control a direction of flow of the heat transfer fluid 406. The number of the control members 402 can vary as per application requirements. Further, the type of the control members 402 may depend on the properties of the heat transfer fluid 406. For example, in case the heat transfer fluid 406 is a liquid, the control member 402 may include suitable types of valves, conduits, and other flow control members.

The controller 404 controls the one or more control members 402 based on a measure of one or more thermodynamic properties of the supercritical fluid 128 at the fluid extraction point 109. For example, the controller 404 can vary a speed of the control members 402 to vary the rate of flow FW of the heat transfer fluid 406 across the first heat exchanger 108 in multiple stages. The measured thermodynamic properties of the supercritical fluid 128 at the fluid extraction point 109 may include one or more of temperature, pressure, specific entropy, specific enthalpy and specific volume. The rate of energy transfer ° out in the first heat exchanger 108 can be controlled by regulating the rate of flow FW of the heat transfer fluid across the first heat exchanger 108.

Each of the controllers 142, 306, 404 described above may include a processor (not shown) and a memory (not shown). The memory may include computer executable instructions that are executable by the processor to perform the various operations that are described above. The processor may be communicably coupled to various sensors and actuators by wired connections and/or wireless connections. Suitable circuitry may be provided to process the signals from the various sensors and provide control signals to the various actuators.

The processor may be any device that performs logic operations. The processor may include a general processor, a central processing unit, an application specific integrated circuit (ASIC), a digital signal processor, a field programmable gate array (FPGA), a digital circuit, an analog circuit, a controller, a microcontroller, any other type of processor, or any combination thereof. The processor may include one or more components operable to execute computer executable instructions or computer code embodied in the memory.

The memory may include at least one computer readable storage medium. Examples of the computer readable storage medium may include a hard disk, a floppy disk, a CD-ROM, a flash drive, a cache, volatile memory, non-volatile memory, RAM, flash memory, or any other type of computer readable storage medium or storage media. The computer readable storage medium may include any type of non-transitory computer readable medium, such as a CD-ROM, a volatile memory, a non-volatile memory, ROM, RAM, or any other suitable storage device.

The trans-critical systems 100, 300, 400 described above may be used for thermal management in various applications, for example, but not limited to, gas turbine engines, internal combustion engines, computing facilities, and heating, cooling and ventilation (HVAC) applications. Contaminants (e.g., the solutes 134) in the working fluid can be removed during normal operation as opposed to complete purging of the system. Oil-lubricated components can be used without any risk of damaging downstream components. The working fluid can be purified periodically to achieve optimal performance. Further, the removal of the contaminants may have minimal impact on system efficiency. Moreover, the trans-critical systems 100, 300, 400 may not require additional separating components, such as filters or strainers that have an associated pressure drop and are susceptible to flow damage, thereby requiring regular replacement to maintain functionality.

Figure 5:
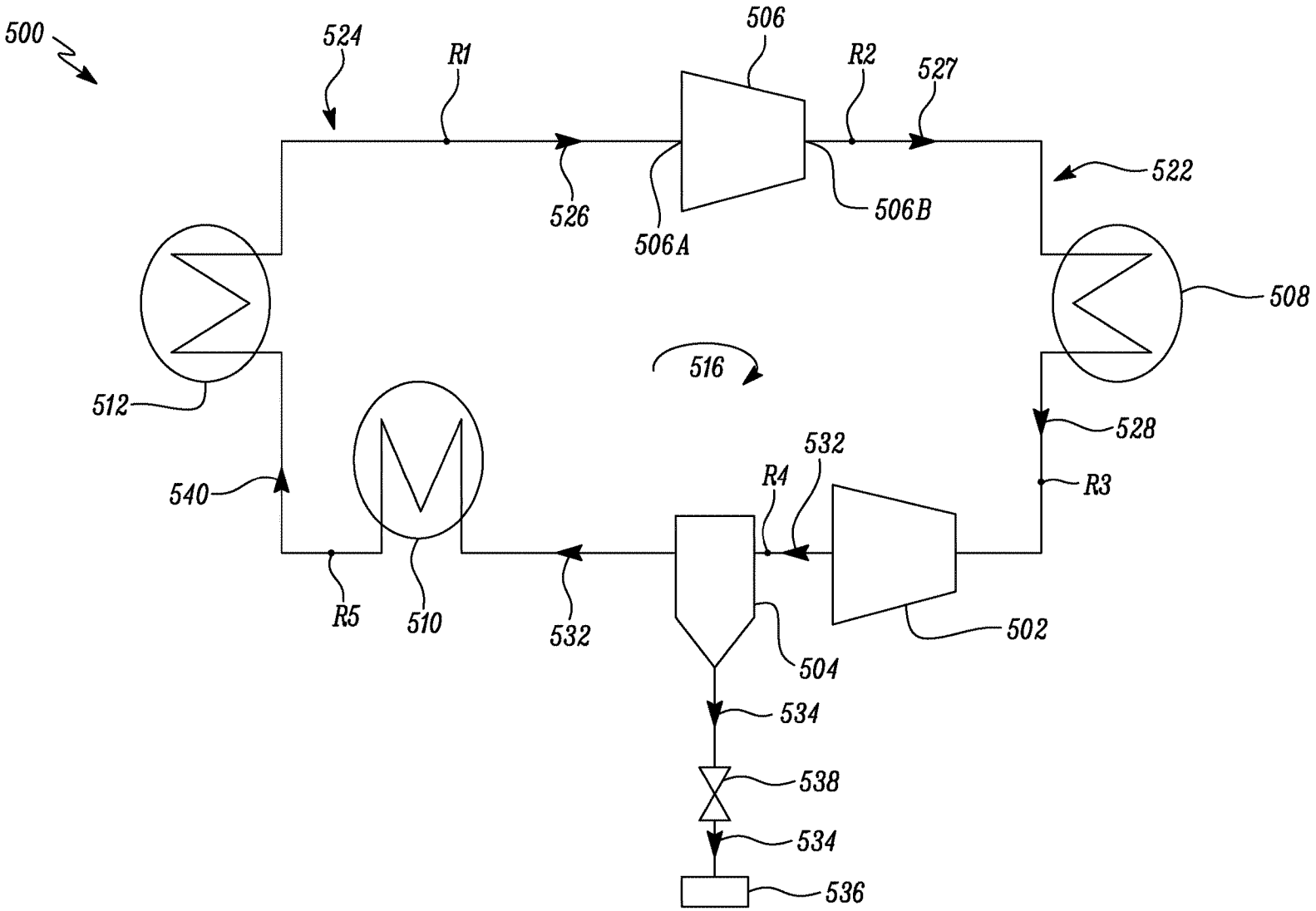
FIG. 5 is a schematic view of a fourth example of a trans-critical thermodynamic system.
Figure 6:
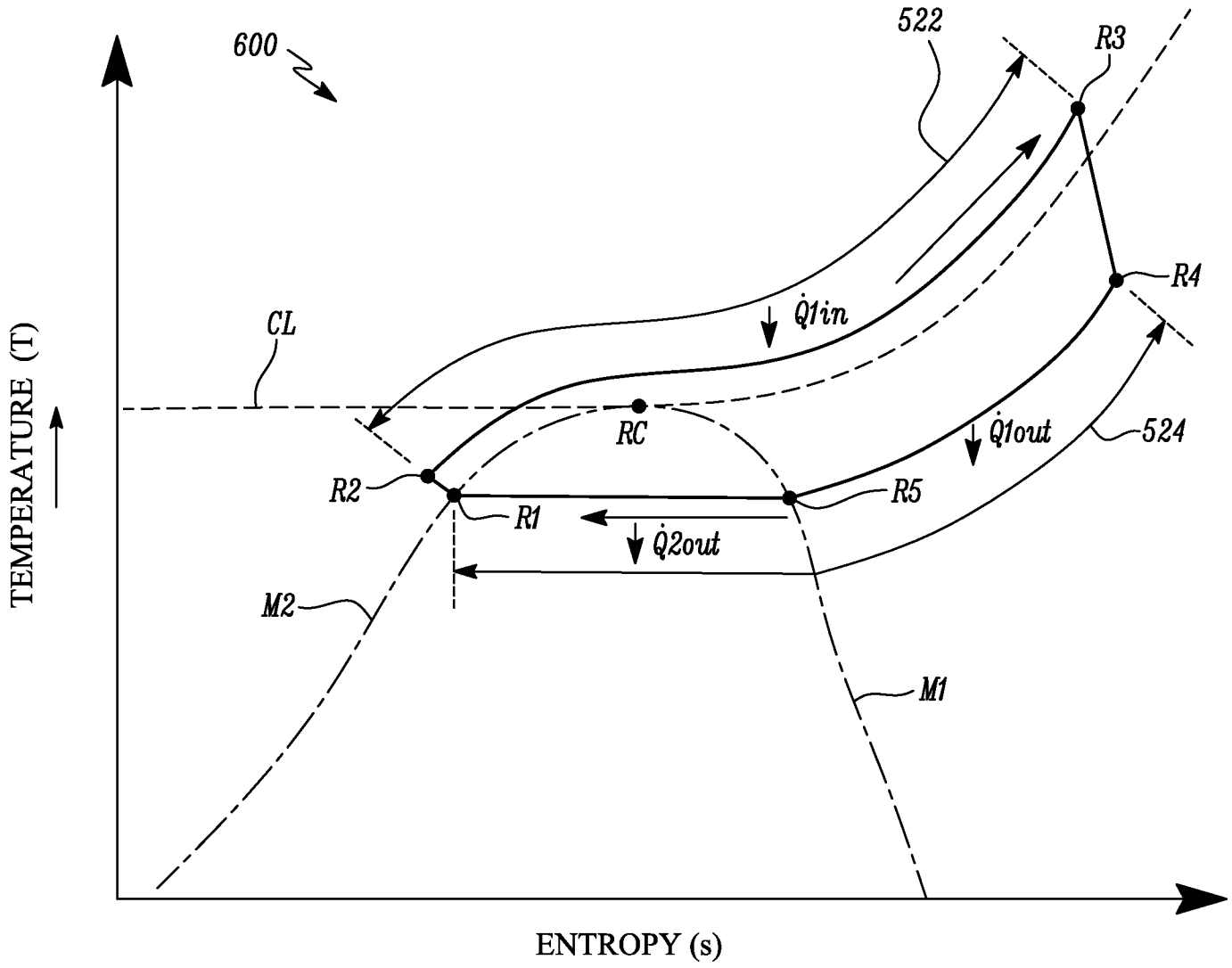
FIG. 6 is a plot of an exemplary thermodynamic cycle for the trans-critical thermodynamic system of FIG. 5.

With reference to FIG. 5, a trans-critical thermodynamic system 500 (hereinafter referred to as "the trans-critical system 500") is provided in accordance with another embodiment of the present disclosure. The trans-critical system 500 includes an expansion device 502, a separator 504, a pump 506, a first heat exchanger 508, a second heat exchanger 510, and a third heat exchanger 512. The first heat exchanger 508 can also be interchangeably referred to as "the heat recovery heat exchanger 508". The trans-critical system 500 uses a working fluid. In some embodiments, the working fluid is carbon dioxide ($CO_2$). FIG. 6 illustrates a plot 600 of temperature (T) versus entropy (s) of the trans-critical system 500. Specifically, the plot 600 is a T-s diagram of the trans-critical system 100. FIG. 6 also schematically illustrates a critical point RC of the working fluid, a saturated vapour line M1 of the working fluid, a saturated liquid line M2 of the working fluid, and a critical boundary line CL between the supercritical state and the sub-critical state of the working fluid.

Referring to FIGS. 5 and 6, the trans-critical system 500 includes a trans-critical circuit 516. The trans-critical circuit 516 includes the expansion device 502, the separator 504, the pump 506, the first heat exchanger 508, the second heat exchanger 510, and the third heat exchanger 512. The trans-critical circuit 516 may be a closed-loop circuit.

Referring to FIGS. 5 and 6, various points in the flow path of the working fluid are defined in the trans-critical system 500. Point R1 is defined in the flow path of the working fluid where a flow of the working fluid is provided at an inlet 506A of the pump 506. Point R2 is defined in the flow path of the working fluid where a flow of the working fluid is received from an outlet 506B of the pump 506. Point R3 is defined in the flow path of the working fluid where a flow of the working fluid is received from an outlet of the first heat exchanger 508. Point R4 is defined in the flow path of the working fluid where a flow of the working fluid is received from an outlet of the expansion device 502. Point R5 is defined in the flow path of the working fluid where a flow of the working fluid is provided to an inlet of the second heat exchanger 510. The working fluid may be in different thermodynamic states in the trans-critical system 500, for example, supercritical state, sub-critical gas, sub-critical liquid, sub-critical liquid and gas mixture, and so forth.

The trans-critical system 500 further includes a high pressure circuit 522 and a low pressure circuit 524. The high pressure circuit 522 is defined from point R2 to point R3. The low pressure circuit 524 is defined from point R4, through point R5, to point R1. The high pressure circuit 522 generally operates at a greater average pressure than the low pressure circuit 524. For a given value of entropy, a point in the high pressure circuit 522 has a higher pressure than a corresponding point in the low pressure circuit 524. The high pressure circuit 522 and the low pressure circuit 524 together form the trans-critical circuit 516.

The pump 506 receives the working fluid from the low pressure circuit 524 at the inlet 506A. The pump 506 receives the flow of working fluid from point R1. At point R1, the working fluid in a saturated liquid 526. In some embodiments, the saturated liquid 526 is $CO_2$ in the saturated liquid state. Point R1 may be located on the saturated liquid line M2. In some other embodiments, point R1 may be offset from the saturated liquid line M2 and located in the sub-critical liquid region. The pump 506 is operable to pressurize the working fluid from the low pressure circuit 524 into the high pressure circuit 522 such that the working fluid becomes a pressurized liquid 527. The pressurized liquid 527 may be a sub-critical liquid. In some embodiments, the pressurized liquid 527 is liquid $CO_2$. The pump 506 may be directly or indirectly driven by a shaft of a gas turbine engine. The pump 506 pressurizes the flow of the working fluid and increases the temperature and pressure of the working fluid at point R2. Point R2 may be located in the sub-critical liquid region. The pump 506 may be any form of mechanism or device capable of pressurizing the working fluid such that working fluid received at a lower pressure by the pump 506 is output at a higher pressure. Point R2 may be below the critical boundary line CL of the working fluid.

The pressurized liquid 527, from the outlet 506B of the pump 506, flows through the high pressure circuit 522. The first heat exchanger 508 is disposed in the high pressure circuit 522 after the pump 506. In other words, the first heat exchanger 508 is disposed downstream of the pump 506. The first heat exchanger 508 may be any device that allows heat exchange between the working fluid and a heat transfer fluid (another liquid or gas) without mixing the two working fluid and the heat transfer fluid together. The first heat exchanger 508 is configured to heat the pressurized liquid 527 to a supercritical fluid 528. Specifically, the first heat exchanger 508 heats the working fluid from point R2 to point R3. Point R3 is located above the critical boundary line CL in the supercritical region.

The expansion device 502 receives the supercritical fluid 528 from the first heat exchanger 508. The expansion device 502 is operable to expand the supercritical fluid 528 to produce a sub-critical gas 532 by reducing a temperature and/or a pressure of the supercritical fluid 528. In the illustrated embodiment of FIG. 5, the expansion device 502 is a turbine. The expansion device 502 expands the supercritical fluid 528 at point R3 to the sub-critical gas 532 at point R4. Point R4 may lie beyond the saturated vapour line M1.

The separator 504 removes one or more solutes 534 from the sub-critical gas 532 received from the expansion device 502. The solutes 534 may condense out of the sub-critical gas 532 and flow out of the separator 504. The separator 504 may be any device that can separate the solutes 534 (e.g., oil) from a gas (e.g., the sub-critical gas 532). The solutes 534 from the separator 504 may flow to a drain 536. An outlet valve 538 may be provided to control a flow of the solutes 534 from the separator 504 to the drain 536. In some embodiments, the separator 504 may be a vapour-liquid separator. In some embodiments, the separator 504 may be an oil separator.

The second heat exchanger 510 receives the sub-critical gas 532 from the separator 504. The second heat exchanger 510 cools the sub-critical gas 532 at point R4 to a saturated gas 540 at point R5. Point R5 may lie on the saturated vapour line M1.

The third heat exchanger 512 receives the saturated gas 540 from the second heat exchanger 510. The third heat exchanger 512 cools the saturated gas 540 at point R5 to the saturated liquid 526 at point R1.

The working fluid may absorb waste heat in the first heat exchanger 508. The expansion device 502 may be used to recover energy from the waste heat absorbed by the working fluid in the first heat exchanger 508. A thermodynamic state at point R3 may be selected to ensure that the temperature and/or the pressure of the working fluid is reduced by expansion in the expansion device 502 to provide the sub-critical gas 532 at point R4. Further, an amount of energy extracted in the expansion device 502 may be maximised while ensuring that the separator 504 receives the working fluid as the sub-critical gas 532. Selection of the thermodynamic state at point R3 may be achieved by passing the pressurized liquid 527 through the first heat exchanger 508. The first heat exchanger 508 may heat the pressurized liquid 527 at a rate of energy transfer $\dot{Q}$1in. The thermodynamic state at point R3 may be controlled by regulating the rate of energy transfer 01 in.

Further, the second heat exchanger 510 may extract heat from the sub-critical gas 532 at a rate of energy transfer $\dot{Q}$1out. The rate of energy transfer $\dot{Q}$1out may be controlled to provide a suitable thermodynamic state at point R5.

Moreover, the third heat exchanger 512 may extract heat from the saturated gas 540 at a rate of energy transfer $\dot{Q}$2out. The rate of energy transfer $\dot{Q}$2out may be controlled to provide a suitable thermodynamic state at point R1.

In some embodiments, the pump 506 can be a positive displacement pump, an impulse pump, and a velocity pump. Examples of positive displacement pumps include, but not limited to, rotary positive displacement pumps, reciprocating positive displacement pumps, and linear-type positive displacement pumps. Rotary positive displacement pumps can include gear pumps, screw pumps, lobe pumps and rotary vane pumps. Reciprocating positive displacement pumps can include plunger pumps, diaphragm pumps and piston pumps. Velocity pumps can include radial-flow pumps, axial-flow pumps, and mixed-flow pumps.

The trans-critical system 500 described above may be used for waste heat recovery in various applications, for example, but not limited to, gas turbine engines, internal combustion engines, computing facilities, and heating, cooling and ventilation (HVAC) applications. Contaminants (e.g., the solutes 134) in the working fluid can be removed during normal operation as opposed to complete purging of the system. Oil-lubricated components can be used without any risk of damaging downstream components. An entire flow of the working fluid can be purified in situ within the main loop. Therefore, the contaminants may be quickly removed and not re-circulated. Further, the trans-critical system 500 may not require additional separating components, such as filters or strainers that have an associated pressure drop and are susceptible to flow damage, thereby requiring regular replacement to maintain functionality. Since the separator 504 is positioned downstream of the expansion device 502, fouling of the first heat exchanger 508 by the contaminants can be prevented.

Figure 7:
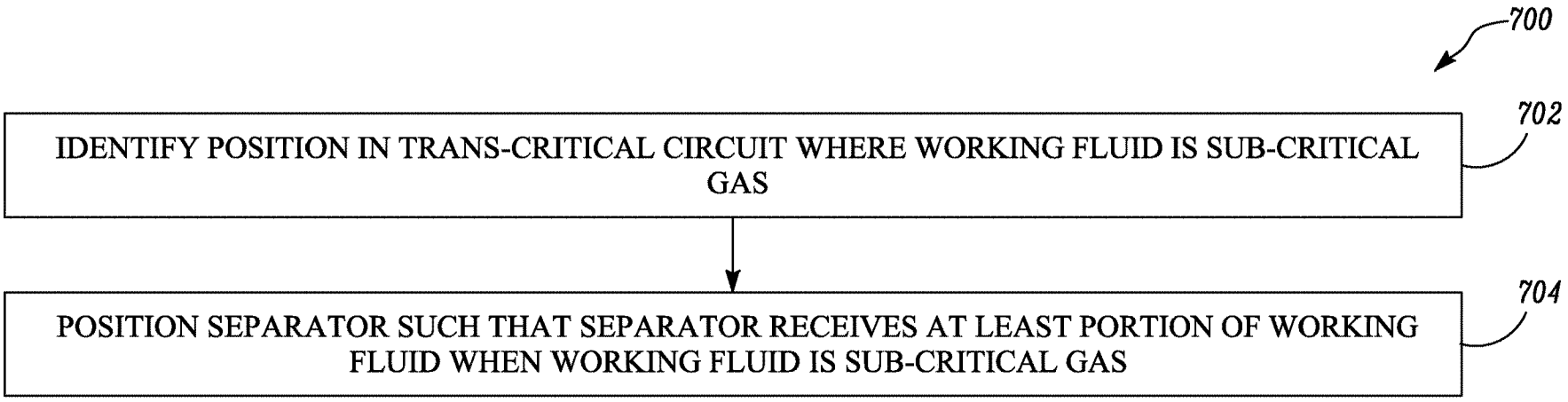
FIG. 7 is a flowchart of an exemplary method of removing solutes from a working fluid in a trans-critical circuit.

FIG. 7 illustrates a method 700 of removing solutes from a working fluid in a trans-critical circuit. The method 700 will be described with reference to the trans-critical system 100 described above with reference to FIGS. 1 and 2. However, the method 700 may be implemented by any one of the trans-critical systems 300, 400, 500 described above.

At step 702, the method 700 includes identifying a position (e.g., point P2') in the trans-critical circuit 116 where the working fluid is the sub-critical gas 132.

The method 700 may further include identifying the fluid extraction point 109 in the trans-critical circuit 116 where the working fluid is the supercritical fluid 128. The method 700 may further include extracting the portion 130 of the supercritical fluid 128 from the fluid extraction point 109 in the trans-critical circuit 116. The method 700 may further include passing the portion 130 of the supercritical fluid 128 through the expansion device 102 such that the portion 130 of the supercritical fluid 128 becomes the sub-critical gas 132.

The method 700 may further include compressing the working fluid upstream of the fluid extraction point 109 such the working fluid becomes the supercritical fluid 128. The method 700 may further include passing at least a fraction of the supercritical fluid 128 through the first heat exchanger 108 located upstream of the fluid extraction point 109. The method 700 may further include controlling the rate of energy transfer ° out in the first heat exchanger 108 based on a measure of one or more thermodynamic properties of the supercritical fluid 128 at the fluid extraction point 109.

At step 704, the method 700 further includes positioning the separator 104 such that the separator 104 receives at least the portion of the working fluid when the working fluid is the sub-critical gas 132. The separator 104 is operable to remove the solutes 134 from the sub-critical gas 132.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A trans-critical thermodynamic system, comprising:

an expansion device configured to receive a supercritical fluid containing solutes, the expansion device operable to expand the supercritical fluid to produce a sub-critical gas by reducing a temperature and/or a pressure of the supercritical fluid;

a separator configured to remove the solutes from the sub-critical gas;

a high pressure circuit configured for the supercritical fluid to flow therethrough; and a fluid extraction point operable to extract a portion of the supercritical fluid from the high pressure circuit, wherein the expansion device is operable to expand the portion of the supercritical fluid.

2. The trans-critical thermodynamic system of claim 1, further comprising:

a low pressure circuit; and a compressor operable to compress a working fluid from the low pressure circuit into the high pressure circuit such that the working fluid becomes the supercritical fluid.

3. The trans-critical thermodynamic system of claim 2, further comprising:

a first heat exchanger in the high pressure circuit configured to receive the supercritical fluid from the compressor, wherein the fluid extraction point is located after the first heat exchanger, wherein the first heat exchanger is configured to cool the supercritical fluid to a thermodynamic state such that the reduction in the temperature and/or the pressure when the portion of the supercritical fluid is passed through the expansion device produces the sub-critical gas having a thermodynamic state matching a position in the low pressure circuit, and wherein the thermodynamic state of the sub-critical gas has a temperature less than a temperature at an inlet of the compressor.

4. The trans-critical thermodynamic system of claim 3, further comprising a controller operable to control a rate of energy transfer in the first heat exchanger based on a measure of one or more thermodynamic properties of the supercritical fluid at the fluid extraction point.

5. The trans-critical thermodynamic system of claim 3, further comprising:

a bypass circuit configured to divert a fraction of the supercritical fluid around the first heat exchanger;

a mixing valve configured to mix the supercritical fluid that has passed through the first heat exchanger with the supercritical fluid that has bypassed the first heat exchanger; and a controller configured to control the mixing valve based on a measure of one or more thermodynamic properties of the supercritical fluid at the fluid extraction point.

6. The trans-critical thermodynamic system of claim 3, further comprising:

one or more control members operable to control a rate of flow of a heat transfer fluid across the first heat exchanger; and a controller configured to control the one or more control members based on a measure of one or more thermodynamic properties of the supercritical fluid at the fluid extraction point.

7. The trans-critical thermodynamic system of claim 1, further comprising:

a solute sensor operable to measure a value representative of an amount of solute in the supercritical fluid, and wherein the portion of the supercritical fluid extracted to pass through the expansion device is controlled based on the value to maintain the amount of solute in the supercritical fluid below a threshold.

8. The trans-critical thermodynamic system of claim 7, wherein the solute sensor is operable to measure a rate of solute collection in the separator.

9. The trans-critical thermodynamic system of claim 1, wherein the fluid extraction point is in fluid communication with a cooling circuit, wherein the supercritical fluid in the high pressure circuit that is not extracted at the fluid extraction point is circulated through the cooling circuit, the cooling circuit comprising:

at least one heat exchanger; and another expansion device.

10. The trans-critical thermodynamic system of claim 1, further comprising a second heat exchanger configured to receive the sub-critical gas from the separator.

11. The trans-critical thermodynamic system of claim 1, further comprising:

a high pressure circuit;

a low pressure circuit;

a pump operable to pressurize a working fluid from the low pressure circuit into the high pressure circuit such that the working fluid becomes a pressurized liquid; and a heat recovery heat exchanger in the high pressure circuit configured to receive the pressurized liquid and heat the pressurized liquid such that the pressurized liquid becomes the supercritical fluid;

wherein the expansion device is configured to receive the supercritical fluid from the heat recovery heat exchanger.

12. A method of removing solutes from a working fluid in a trans-critical circuit, the method comprising:

identifying a position in the trans-critical circuit where the working fluid is a sub-critical gas;

positioning a separator such that the separator receives at least a portion of the working fluid when the working fluid is the sub-critical gas, the separator operable to remove solutes from the sub-critical gas, identifying a fluid extraction point in the trans-critical circuit where the working fluid is a supercritical fluid;

extracting a portion of the supercritical fluid from the fluid extraction point in the trans-critical circuit; and passing the portion of the supercritical fluid through an expansion device such that the portion of the supercritical fluid becomes the sub-critical gas.

13. The method of claim 12, further comprising:

compressing the working fluid upstream of the fluid extraction point such that the working fluid becomes the supercritical fluid;

passing at least a fraction of the supercritical fluid through a first heat exchanger located upstream of the fluid extraction point; and controlling a rate of energy transfer in the first heat exchanger based on a measure of one or more thermodynamic properties of the supercritical fluid at the fluid extraction point.

* * * * *